US009764921B2

(12) United States Patent
Rohrbach et al.

(10) Patent No.: US 9,764,921 B2
(45) Date of Patent: Sep. 19, 2017

(54) FOLDING POCKET DEVICE FOR A BUCKLE FOLDING MACHINE

(71) Applicant: Maschinenbau Oppenweiler Binder GmbH & Co. KG, Oppenweiler (DE)

(72) Inventors: Joerg Rohrbach, Marbach (DE); Claus-Dieter Redmer, Oppenweiler (DE)

(73) Assignee: Maschinenbau Oppenweiler Binder GmbH & Co. KG, Oppenweiler (DE)

( * ) Notice: Subject to any disclaimer, the term of this patent is extended or adjusted under 35 U.S.C. 154(b) by 863 days.

(21) Appl. No.: 13/870,385

(22) Filed: Apr. 25, 2013

(65) Prior Publication Data

US 2013/0345037 A1 Dec. 26, 2013

(30) Foreign Application Priority Data

Apr. 27, 2012 (DE) ..... 10 2012 207 038

(51) Int. Cl.
*B65H 45/04* (2006.01)
*B65H 45/00* (2006.01)
*B65H 45/14* (2006.01)

(52) U.S. Cl.
CPC ..... *B65H 45/00* (2013.01); *B65H 45/04* (2013.01); *B65H 45/144* (2013.01); *B65H 45/148* (2013.01)

(58) Field of Classification Search
USPC ..... 493/419, 449, 457, 30, 34, 454; 270/52.24
See application file for complete search history.

(56) References Cited

U.S. PATENT DOCUMENTS 2,253,446 A * 8/1941 Spiess ..... B65H 45/142 493/360
3,698,705 A * 10/1972 Funk ..... B65H 45/12 493/19

(Continued)

FOREIGN PATENT DOCUMENTS

DE 3840856 A1 7/1989
DE 9211016 U1 12/1992

(Continued)

OTHER PUBLICATIONS

European Search Report for EP Application No. 13165047.5 dated Jul. 23, 2013.

(Continued)

*Primary Examiner* — Sameh Tawfik
(74) *Attorney, Agent, or Firm* — Bachman & LaPointe, PC

(57) ABSTRACT

The folding pocket device for a buckle folding machine includes a folding pocket having a feed-in aperture enabling a sheet to run therethrough in a running-in direction into a pocket space of the folding pocket. A sheet stop device includes a sheet stop extending essentially transversely to the running-in direction in the pocket space, which is displaceable in the running-in direction and in the opposite direction. A sheet directing device includes a diverting device, which is displaceable from a clearance position in which the diverting device opens up the way to the feed-in aperture into the folding pocket to a diverting position in which the diverting device blocks the feed-in aperture in order to divert a sheet. In order to achieve quick switching from the clearance position to the diverting position, the diverting device can be displaced from the clearance position to the diverting position by the sheet stop when the sheet stop is displaced opposite to the running-in direction.

6 Claims, 2 Drawing Sheets

(56) References Cited

U.S. PATENT DOCUMENTS

| | | | | |
|---|---|---|---|---|
| 3,975,009 | A * | 8/1976 | Brown | B65H 45/144 493/14 |
| 5,041,074 | A * | 8/1991 | Zwimpfer | B65H 45/144 493/420 |
| 5,180,357 | A * | 1/1993 | Marzullo | B65H 45/144 493/420 |
| 5,322,498 | A * | 6/1994 | Lehmann | B65H 45/148 493/420 |
| 5,769,774 | A * | 6/1998 | Beck | B65H 45/148 493/419 |
| 6,446,958 | B1 * | 9/2002 | Sette | B65H 5/06 271/186 |
| 6,635,006 | B2 * | 10/2003 | Auerbach | B43M 3/045 493/419 |
| 6,857,996 | B2 * | 2/2005 | Dorer | B65H 45/144 270/32 |
| 8,628,457 | B2 * | 1/2014 | Terlau | B65H 45/142 271/149 |
| 2001/0044367 | A1 | 11/2001 | Belmann et al. | |
| 2003/0001325 | A1 * | 1/2003 | Dorer | B65H 45/144 270/32 |
| 2004/0102301 | A1 | 5/2004 | Szczerba | |
| 2005/0055891 | A1 | 3/2005 | Kuebler | |

FOREIGN PATENT DOCUMENTS

| | | | |
|---|---|---|---|
| DE | 4213519 | C1 | 12/1993 |
| EP | 1422178 | A1 | 5/2004 |
| EP | 1442178 | A1 | 8/2004 |
| JP | 55165859 | A | 12/1980 |
| JP | 63-139268 | | 9/1988 |
| JP | 200220032 | A | 1/2002 |
| JP | 2006062867 | A | 3/2006 |
| JP | 2007308209 | A | 11/2007 |

OTHER PUBLICATIONS

Japanese office action for application No. 2013-095395 dated Oct. 24, 2016.

* cited by examiner

FOLDING POCKET DEVICE FOR A BUCKLE FOLDING MACHINE

BACKGROUND OF THE INVENTION

The invention relates to a folding pocket device for a buckle folding machine.

DE 38 40 856 A1 discloses a folding pocket device for a buckle folding machine including a sheet stop arranged in a pocket space of a folding pocket, wherein the sheet stop can be adjusted in the running-in direction of the sheet in order to be adapted to the sheet length. Furthermore a sheet directing means is provided by which the feed-in aperture into the folding pocket can be blocked such that the sheet is diverted without being folded in the folding pocket. A linear motor is provided for moving the sheet directing means from a clearance position in which the sheet directing means opens up the way to the feed-in aperture into the folding pocket to a diverting position in which the sheet directing means blocks the feed-in aperture in order to divert a sheet.

DE 92 11 016 U1 discloses a generic folding pocket device for a buckle folding machine wherein the sheet stop is configured to serve simultaneously as a sheet directing means. In order to block the feed-in aperture into the folding pocket, the sheet stop is moved by a drive from a previous stop position to a front diverting position in which the sheet stop serves as a sheet directing means. To ensure that the sheet is reliably diverted, the sheet stop includes individual stop elements which have a concave configuration. The individual stop elements are arranged between the pocket bars of the folding pocket, which makes it impossible to form a continuous stop surface. This may cause stop marks to be formed at the hitting edge of sheets. Furthermore the distance which the stop must travel from the stop position to the diverting position is relatively long, thereby limiting the cycle times of the folding machine.

The object underlying the invention is to provide a folding pocket device for a buckle folding machine using means of simple design which allows quick switching from a stop position to a diverting position in order to achieve short cycle times.

SUMMARY OF THE INVENTION

This object is achieved according to the invention by a folding pocket device comprising a folding pocket having a feed-in aperture enabling a sheet to run therethrough in a running-in direction into a pocket space of said folding pocket; sheet stop means including a sheet stop extending substantially transversely to said running-in direction in said pocket space and being displaceable in and opposite to said running-in direction; and sheet directing means including diverting means being displaceable from a clearance position in which said diverting means opens up the way to said feed-in aperture into said folding pocket to a diverting position in which said diverting means blocks said feed-in aperture in order to divert a sheet, wherein said diverting means can be displaced from said clearance position to said diverting position by said sheet stop when said sheet stop is displaced opposite to said running-in direction.

The distance by which the sheet stop has to be moved for the displacement of the diverting means is relatively small as compared to the travel distance of the sheet stop known from DE 92 11 016 U1 because the stop itself does not have to be displaced up to the diverting position. This allows short cycle times and switching during ongoing operations for adapting to a new job. Nevertheless only a single drive is required to displace the sheet stop and the diverting means, resulting in low constructional effort. Finally it is not required—as, for example, in the case of the sheet stop known from DE 92 11 016 U1—to configure the stop surface to be suitable both for stopping a sheet and for diverting a sheet. In the case of the folding pocket device according to the invention the diverting means can be configured optimally for diverting a sheet, whereas the stop surface of the sheet stop can be designed corresponding to the stop function. Moreover, in cases where pocket rods are used for the folding pocket, it is also possible to configure the sheet stop to be continuous, as it is known, for example, from EP 1 442 178 A1.

Preferably the sheet directing means includes resilient means, preferably a helical return spring, which is configured and arranged such that it is compressed when the sheet stop displaces the diverting means opposite to the running-in direction (ER) to the diverting position, and that it displaces the diverting means back to the clearance position by its spring force when the sheet stop is displaced back in the running-in direction. In other words, the diverting means is automatically displaced back to the clearance position when the sheet stop is to perform a stop function again.

In the case of a preferred embodiment, the sheet stop includes a stop rail which extends transversely to the running-in direction in the pocket space and can be displaced preferably by two actuating drives which are connected to the stop rail at two spaced-apart positions arranged transversely to the running-in direction. The two actuating drives allow oblique positioning of the sheet stop.

In an exemplary embodiment with a simple design, but with reliable functioning, the sheet directing means includes a transverse rail connected to the diverting means and extending transversely to the running-in direction in the pocket space, wherein the transverse rail is arranged such that the sheet stop hits the transverse rail after a predetermined movement opposite to the running-in direction and displaces the transverse rail during a continued movement opposite to the running-in direction until the diverting means blocks the feed-in aperture.

In the case of this embodiment, the transverse rail is preferably connected to a transverse strip by at least one connecting rod guided in a frame-fixed guide. The diverting means includes a plurality of spaced-apart diverting elements attached to the transverse strip and arranged transversely to the running-in direction.

In the case of this embodiment, the resilient means is advantageously formed by a helical return spring which is supported on the one hand on the guide and on the other hand on the connecting rod.

BRIEF DESCRIPTION OF THE DRAWINGS

Hereinafter an exemplary embodiment of the invention will be described in more with reference to the accompanying drawings, in which.

DETAILED DESCRIPTION

Figure 3:
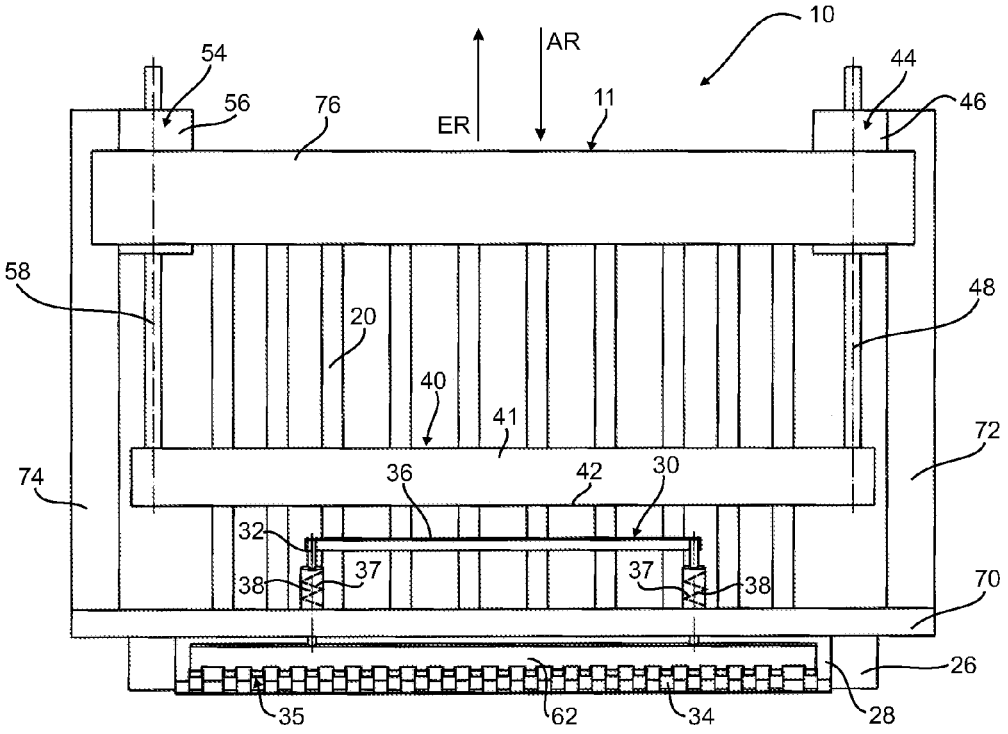
FIG. 3 shows a plan view of the folding pocket device of FIG. 1.

As can be seen in FIG. 3, the folding pocket device 10 includes a folding pocket 11 comprising two transverse beams 70, 76, which are arranged at a distance apart, and two longitudinal beams 72, 74, which interconnect the outer ends of the transverse beams 70, 76.

In a known manner the folding pocket 11 includes a plurality of upper pocket bars 20 which are arranged at a distance apart, wherein below each of the upper pocket bars 20 there is arranged a lower pocket bar 22 at a distance apart such that a pocket space 24 is formed between the pocket bars 20, 22.

A feed-in aperture 25 for a sheet running into the pocket space 24 is formed by an upper feed-in plate 28 and a lower feed-in blade 26. The feed-in plates 26, 28 extend into a roller space 18 surrounded by three folding rollers 12, 14 and 16. The folding rollers 14, 16 form a first folding roller pair between which a sheet is transported through the feed-in aperture 25 in a running-in direction ER into the pocket space 24 when the feed-in aperture 25 is open. Thereafter the sheet hits a sheet stop 40 whereupon a sheet buckle is created in the roller space 18 which is grabbed by the folding rollers 12, 14, which form a second folding roller pair, such that a fold is created. Then the sheet is transported in an exiting direction AR, which is opposed to the running-in direction, out of the folding pocket 11.

Figure 1:
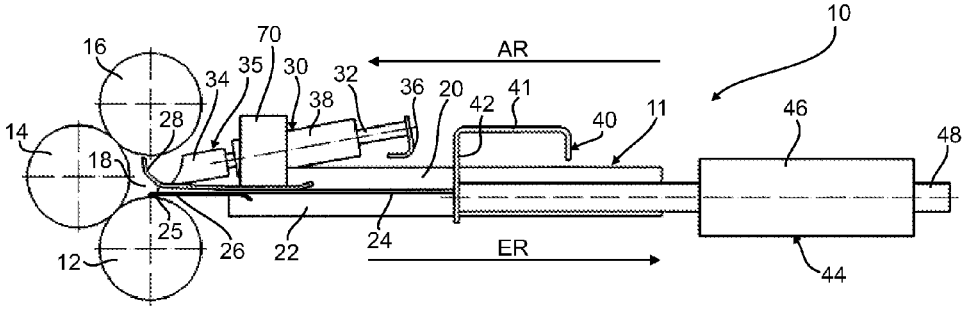
FIG. 1 shows a cross section through a folding pocket device, wherein a diverting means is in a clearance position.

In FIG. 1 the sheet stop 40 is in a rear stop position. The sheet stop 40 comprises a stop rail 41 including a vertically extending front stop surface 42. Although it cannot be seen in FIGS. 1 to 3, the stop surface 42 and the pocket bars 20, 22 are preferably configured as disclosed in EP 1 422 178 A1, i. e. the pocket bars 20, 22 have an internal recess on their side facing the pocket space 24. The stop surface 42 passes through the pocket space 24 between the pocket bars 20, 22. Outer stops are arranged between neighbouring pocket bars 20, 22, and inner stops are arranged within the pocket bars, wherein the inner stops each extend into the internal recesses of the pocket bars 20, 22. Furthermore the inner stops are connected to the neighbouring outer stops by a connecting bridge having a width which is smaller than the height of the pocket space 24 between the pocket bars 20, 22.

As can be seen in FIG. 3, the stop rail 41 laterally extends beyond the arrangement of pocket bars 20 and 22, respectively. A linear motor 54 is mounted at the longitudinal beam 74 below the transverse beam 76 and includes a motor housing 56 and a push rod 58. The front end of the push rod 58 is connected to the stop rail 41. Likewise a linear motor 44 is attached below the transverse beam 76 to the longitudinal beam 72 at the right-hand side of FIG. 3 and drives a push rod 48 guided in a motor housing 46, the front end of the push rod 48 being connected to the stop rail 41. Thus the linear motors 44, 54 enable movement of the stop rail 41 in the running-in direction ER and in the exiting direction AR of a sheet in the folding pocket 11, wherein the fact that the motors 44, 54 are separately driven allows oblique positioning of the stop rail 41.

The folding pocket device 10 further includes sheet directing means 30 attached to the front transverse beam 70. Herein two cylinder guides 38 are mounted at the transverse beam 70 such that they extend in the running-in direction ER as seen in the top view of FIG. 3. In each of the cylinder guides 38 there is guided a connecting rod 32 which passes through the cylinder guides 38. The ends of the connecting rods 32 facing the sheet stop 40 are connected by a transverse rail 36 whereas the other ends of the connecting rods 32 are connected to a transverse strip 62 of diverting means 35. A plurality of diverting elements 34 are provided at a distance apart at the front side of the transverse strip 62.

Figure 2:
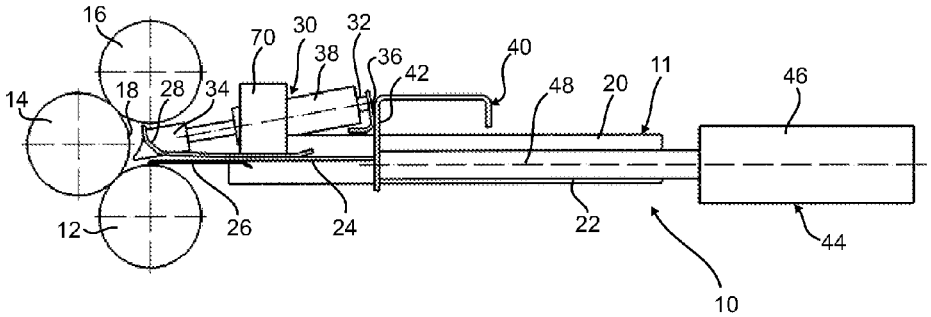
FIG. 2 shows the folding pocket device of FIG. 1, wherein the diverting means is in a diverting position.

As can be seen in FIGS. 1 and 2, the guides 38 have a slight downward inclination towards the direction of the feed-in aperture 25. The connecting rod 32 is biased into the clearance position shown in FIG. 1 by a helical return spring (not shown), wherein the return spring surrounds the connecting rod 32 and is arranged within the guide 38. The return spring is supported on the one hand on the guide 38 and on the other hand on the connecting rod 32.

From the position shown in FIG. 1, in which the diverting elements 34 are located above the feed-in aperture 25, the connecting rod 32 can be moved opposite to the running-in direction ER, i. e. in the exiting direction AR, to such an extent that the diverting elements 34 block the feed-in aperture 25. When in the latter position a sheet is introduced between the folding rollers 14, 16, it is diverted by the diverting elements 34 such that its leading edge is grabbed by the folding rollers 12, 14, so that the sheet is transported further without being folded by the folding pocket 11.

In FIG. 1 the diverting elements 34 are located above the feed-in aperture 25, and the sheet stop 40 is located in a stop position adjusted by the linear motors 44, 54. In this case a sheet is grabbed by the folding rollers 14, 16, is introduced through the feed-in aperture 25 and then hits the stop surface 42 of the sheet stop 40.

If the diverting elements 34 are to be moved from the clearance position shown in FIG. 1 to the diverting position shown in FIG. 2, the stop rail 41 of the sheet stop 40 is moved in the exiting position AR by the linear motors 44 and 54. During this movement the stop surface 42 hits the transverse rail 36, thereby displacing the connecting rod 32 opposite to the force of the return spring, causing the diverting elements 34 to sink into the feed-in aperture 25.

If the diverting elements 34 are to be moved again to the clearance position, the stop rail 41 of the sheet stop 40 is moved again in the feed-in direction ER by the linear motors 44, 54 until the stop surface 42 is located at a predetermined position for stopping a sheet, which is required for a particular job. The transverse rail 36 is moved back again to the initial position shown in FIG. 1 by the spring force of the return spring acting on the connecting rods 32, so that the diverting elements 34 are located above the feed-in aperture 25.

In the case of the embodiment described above the stop rail 41 hits and displaces the transverse rail 36. It is however also possible to couple the connecting rods 32 other than by a transverse rail. In this case the stop rail 41 directly hits the connecting rods 32.

Furthermore the linear motors with connecting rods employed in the case of the embodiment described above may be replaced by servo motors with spindles.

The invention claimed is:

1. Folding pocket device for a buckle folding machine, comprising a folding pocket having a feed-in aperture enabling a sheet to run therethrough in a running-in direction into a pocket space of said folding pocket;

sheet stop means including a sheet stop extending substantially transversely to said running-in direction in said pocket space and being displaceable in and opposite to said running-in direction; and sheet directing means including diverting means being displaceable from a clearance position in which said diverting means opens up the way to said feed-in aperture into said folding pocket to a diverting position in which said diverting means blocks said feed-in aperture in order to divert a sheet, wherein said diverting means can be displaced from said clearance position to said diverting position by said sheet stop when said sheet stop is displaced opposite to said running-in direction;

wherein said sheet directing means includes a transverse rail fixedly attached to said diverting means and extending transversely to said running-in direction, wherein said transverse rail and said sheet stop are arranged at a distance apart from each other in said running-in direction, wherein said sheet stop hits said transverse rail after a predetermined movement opposite to said running-in direction and to then displaces said transverse rail during a continued movement opposite to said running-in direction until said diverting means blocks said feed-in aperture; and wherein said transverse rail is fixedly attached to a transverse strip by at least one connecting rod guided in a frame-fixed guide and said diverting means includes a plurality of spaced-apart diverting elements arranged on the transverse strip transversely to said running-in direction.

2. Folding pocket device according to claim 1, wherein said sheet directing means includes resilient means comprising return springs configured and arranged such that it is compressed when said sheet stop displaces said diverting means opposite to said running-in direction to said diverting position, and that it displaces said diverting means to said clearance position when said sheet stop is displaced back in said running-in direction.

3. Folding pocket device according to claim 2, wherein said resilient means is formed by a helical return spring which is supported on the one hand on said guide and on the other hand on said connecting rod.

4. Folding pocket device according to claim 1, wherein said sheet stop includes a stop rail which extends transversely to said running-in direction in said pocket space.

5. Folding pocket device according to claim 4, wherein said stop rail can be displaced by two actuating drives which are connected to said stop rail at two spaced-apart positions arranged transversely to said running-in direction.

6. Folding pocket device according to claim 1, wherein said sheet stop has a continuous stop surface.

* * * * *